US005093937A

United States Patent [19]

Kamata

[11] Patent Number: 5,093,937

[45] Date of Patent: Mar. 10, 1992

[54] HELMET FOR RIDING VEHICLE

[75] Inventor: Eitaro Kamata, Tokyo, Japan

[73] Assignee: Shoei Kako Kabushiki Kaisha, Tokyo, Japan

[21] Appl. No.: 680,966

[22] Filed: Apr. 5, 1991

[30] Foreign Application Priority Data

Oct. 3, 1990 [JP] Japan ..... 2-265555

[51] Int. Cl.[5] ..... A42B 1/08

[52] U.S. Cl. ..... 2/424; 2/425; 2/171.3

[58] Field of Search ..... 2/10, 12, 171.3, 410, 2/422, 424, 425

[56] References Cited

U.S. PATENT DOCUMENTS 4,054,953 10/1977 DeBarsy ..... 2/425
4,115,874 9/1978 Hasegawa ..... 2/425
4,519,099 5/1985 Kamiya et al. ..... 2/424
4,575,875 3/1986 Dawson et al. ..... 2/422
4,700,411 10/1987 Kawasaki et al. ..... 2/425
4,813,083 3/1989 Davidson ..... 2/422

FOREIGN PATENT DOCUMENTS 2498060 7/1982 France ..... 2/424

*Primary Examiner*—Andrew M. Falik
*Assistant Examiner*—Michael A. Neas
*Attorney, Agent, or Firm*—Armstrong, Nikaido, Marmelstein, Kubovcik & Murray

[57] ABSTRACT

A helmet for vehicle ride includes a cap body, a visor mounted on the cap body to define a travelling-wind flow-in space between the visor and a front wall of the cap body, and an air intake hole provided in the front wall to be open to the travelling-wind flow-in space. The visor includes an escape opening for permitting the travelling wind taken into the travelling-wind flow-in space to be escaped therethrough, and a shutter for opening and closing the escape opening.

3 Claims, 8 Drawing Sheets

HELMET FOR RIDING VEHICLE

BACKGROUND OF THE INVENTION

1. FIELD OF THE INVENTION

The field of the present invention is a helmet for riding a vehicle, principally used by a motorcycle rider or the like, and more particularly, improvements in a helmet comprising a cap body, a visor mounted on the cap body to define a travelling-wind flow-in space between the visor and a front wall of the cap body, and an air intake hole provided in the front wall to be open to the travelling-wind flow-in space.

2. DESCRIPTION OF THE PRIOR ART

A helmet of such a type has been already proposed by the present applicant (see the specification and drawings of Japanese Utility Model Application No. 117511/89).

The helmet of this type has an advantage that much travelling wind can be collected into the travelling-wind flow-in space and supplied to the air intake hole by utilizing the entire visor, thereby providing an effective ventilation within the cap body.

In the already proposed helmet, in order to adjust the flow rate of the travelling wind into the air intake hole, a shutter is mounted on the front wall of the cap body for opening and closing the air intake hole. However, such helmet suffers from a disadvantage that particularly if a visor having a larger length of projection from the cap body is used, the operation of opening and closing the shutter may be obstructed by the visor and thus becomes difficult.

SUMMARY OF THE INVENTION

It is an object of the present invention to provide a helmet of the above-described type for riding a vehicle, wherein the adjustment of the flow rate into the air intake hole can easily be conducted without losing the above advantage.

To achieve the above object, according to the present invention, there is provided a helmet for riding a vehicle, comprising a cap body, a visor mounted on the cap body to define a travelling-wind flow-in space between the visor and a front wall of the cap body, and an air intake hole provided in the front wall to be open to the travelling-wind flow-in space, wherein the visor includes an escape opening for permitting a travelling wind taken into the travelling-wind flow-in space to be escaped therethrough, and a shutter for opening and closing the escape opening.

With the above construction, the flow rate of the wind supplied into the air intake hole by utilizing the entire visor can be effectively increased by closing the shutter mounted on the visor, while the pressure generated inside the visor can be reduced by opening the shutter to reduce the flow rate of the wind into the air intake hole and to reduce the flapping action to be caused by the travelling wind on the visor. Moreover, since the shutter is mounted on the visor, the opening and closing operation thereof is easy.

The above and other objects, features and advantages of the invention will become apparent from a reading of the following description of the preferred embodiments, taken in conjunction with the accompanying drawings.

DESCRIPTION OF THE PREFERRED EMBODIMENTS

Figure 1:
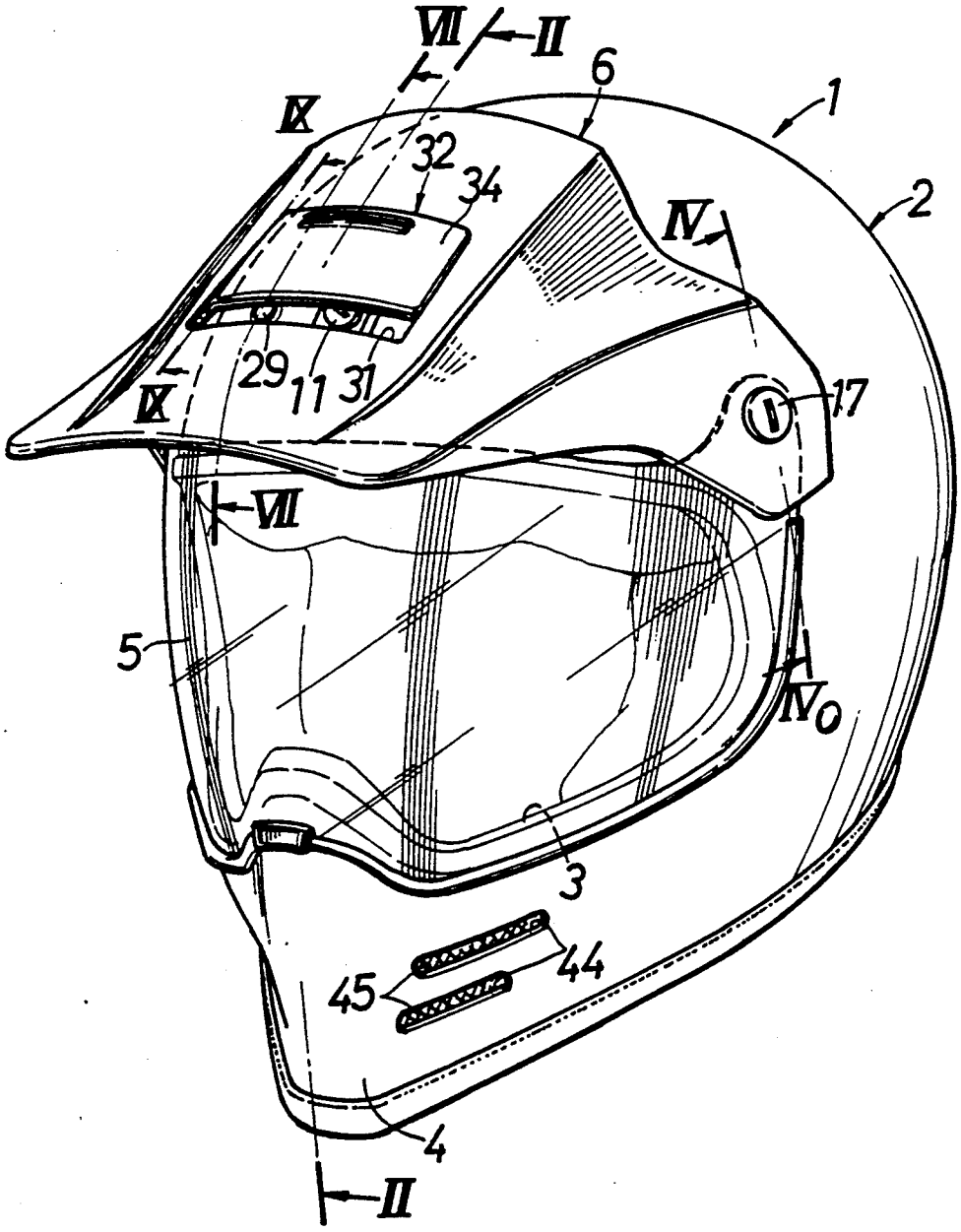
FIG. 1 is a perspective view of a helmet with a shutter opened and a shield plate held at a closed position.
Figure 2:
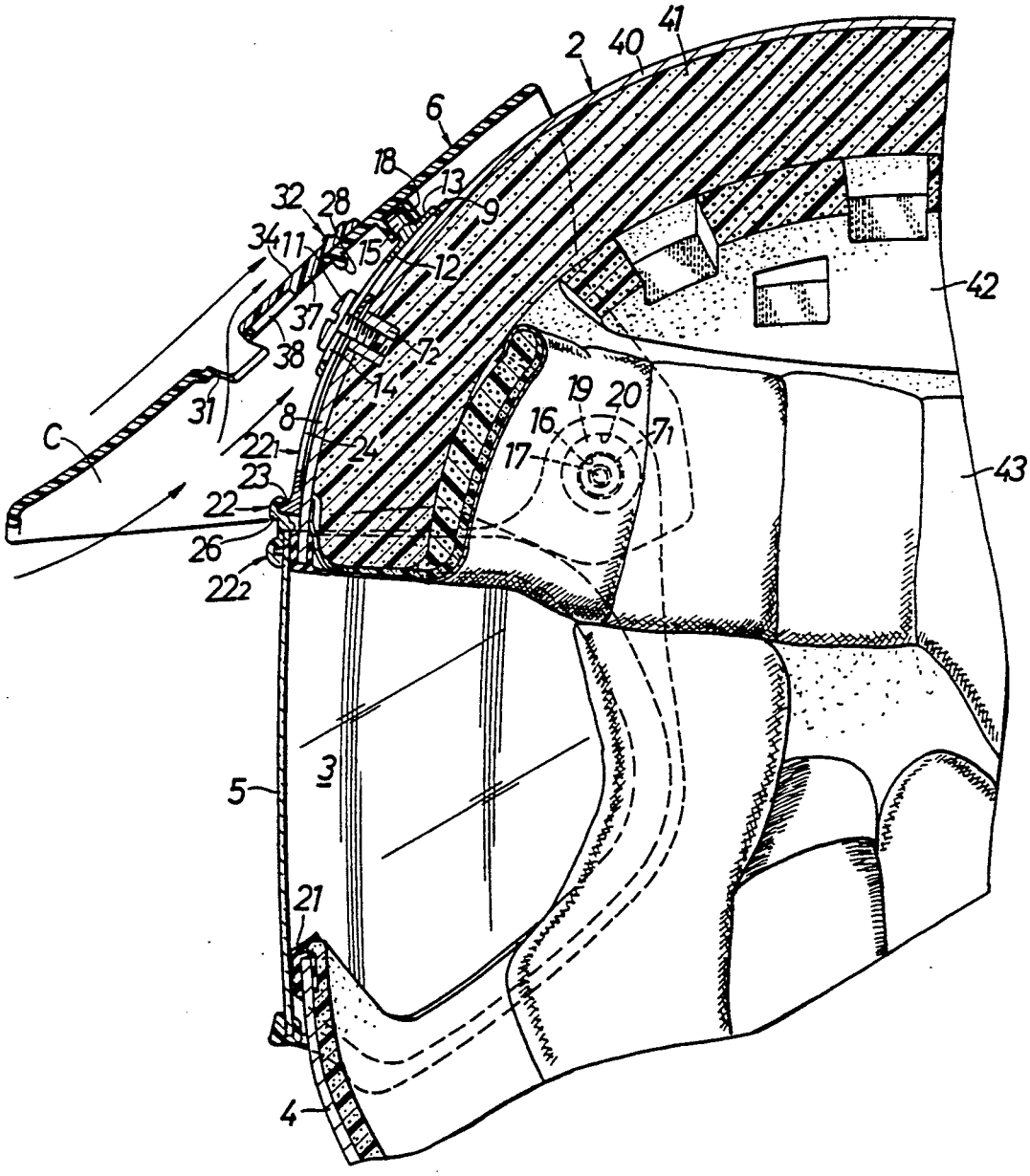
FIG. 2 is a sectional view taken along a line II—II in FIG. 1.
Figure 3:
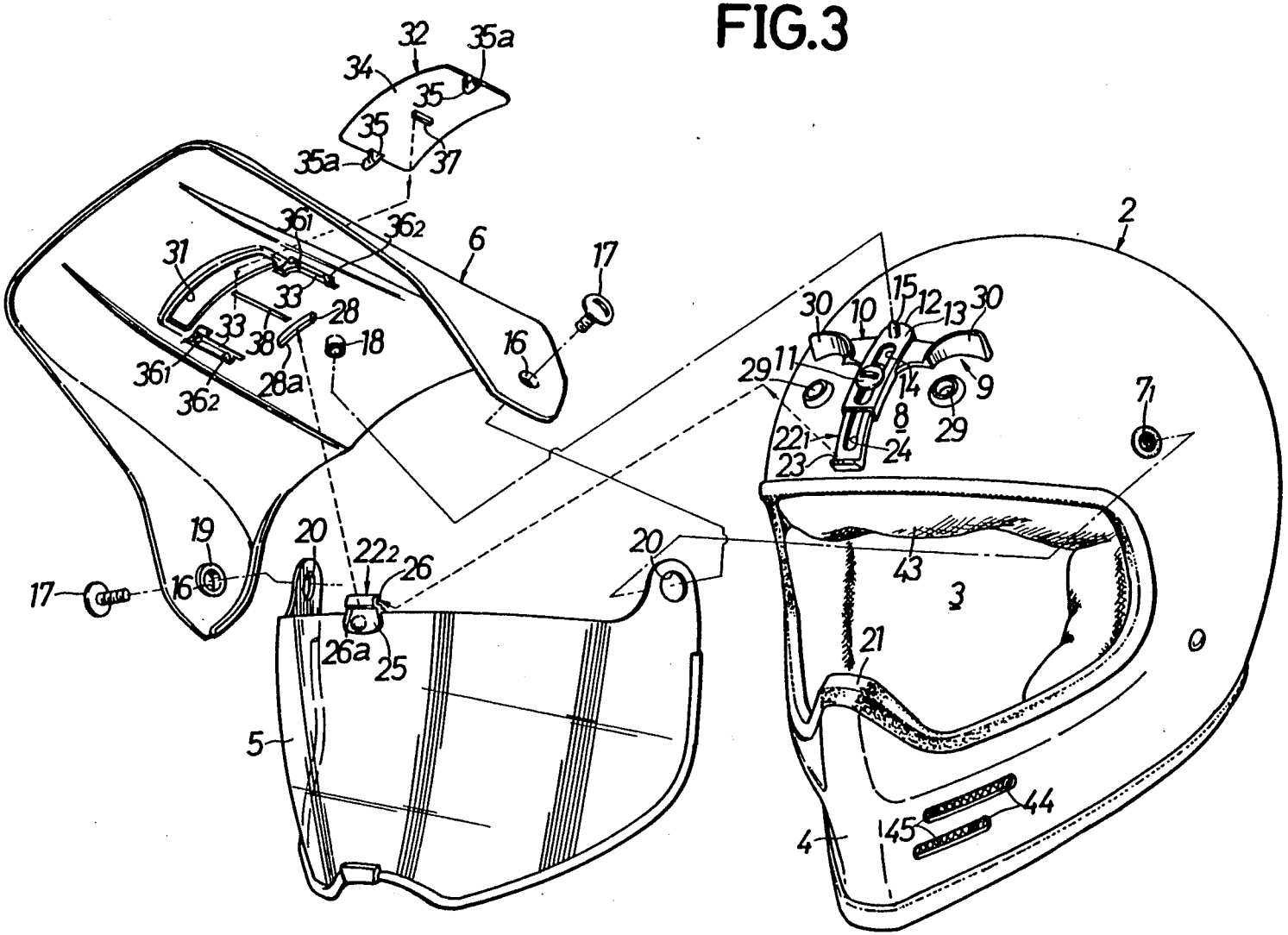
FIG. 3 is an exploded perspective view of the helmet.

Referring to FIGS. 1 to 3, a helmet 1 for riding a vehicle is shown to have a cap body 2 formed into a full-face type having a chin cover portion 4 immediately below an opening 3 in a front face. A shield plate 5 and a visor 6 are detachably mounted on the cap body 2.

The shield plate 5 and the visor 6 are formed of synthetic resin, and the mounting structure thereof to the cap body 2 will be described below.

Figure 4:
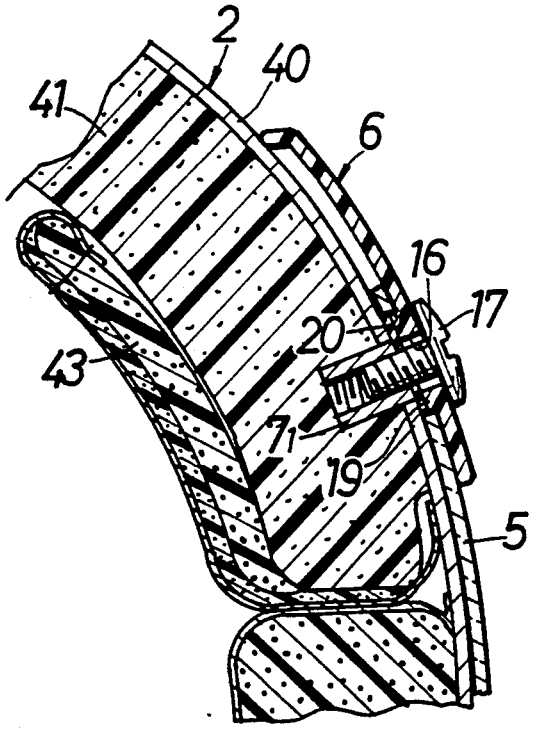
FIG. 4 is a sectional view taken along a line IV—IV in FIG. 1.

As clearly shown in FIGS. 3 and 4, a nut 7, is embedded in each of left and right sidewalls of the cap body 2, and at a laterally central portion of a front wall 8 of the cap body 2, there is provided with an adjusting means 9 for adjusting the mounting position of the visor 6 in a longitudinal or front and rear direction of the cap body.

The adjusting means 9 is comprised of a body 10 of a substantilly T-shape as viewed in a plane, and a machine screw 11 serving as a fixing element threadedly engaged in a nut $7_2$ of the cap body 2 to fix the body 10 to the cap body 2. The body 10 includes a channeled main portion 12 and an elongated hole 14 is provided in a ceiling wall 13 of the main portion 12 so as to extend longitudinally of the cap body for receiving the machine screw 11 therethrough. A projecting stopper 15 is provided on an outer surface of the ceiling wall 13 rearwardly of the elongated hole 14. Thus, the body 10 is movable longitudinally of the cap body by loosening the machine screw 11 and is capable of being fixed, by the machine screw 11, to the cap body at any position in a region of movement thereof limited by the elongated hole 14.

A mounting hole 16 is provided in each of left and right opposite ends of the visor 6, and a machine screw 17 is passed through each of the mounting holes 16 and is threadedly engaged into the nut $7_1$. A cylindrical support 18 is projectingly mounted on an inner surface of the visor 6 at a laterally central portion thereof closer to a rear edge and is engaged (fitted over in the illustrated embodiment) with the stopper 15.

In this manner, the visor 6 is attached to the cap body 2 so as to project forwardly of the opening 3 in the front face along a line tangent to an outer surface of the cap body 2, so that the movement of the visor 6 in the longitudinal direction of the cap body 2 is limited by the stopper 15.

If the mounting position of the visor 6 in the longitudinal direction of the cap body 2 is desired to be adjusted in order to deal with flapping by wind, shading from the sunlight, insurance of the field of view and the like, the machine screw 11 may be loosened to move the body 10. This ensures the mounting position of the visor 6 in the longitudinal direction of the cap body being easily adjusted. The mounting position after adjustment is held by threadedly tightening the machine screw 11 into the nut $7_2$.

Even if the visor 6 is removed from the cap body 2 for the purpose of cleaning of the visor 6 and the cap body 2 or for another purpose, the adjusting means 9 is left on the cap body 2. Therefore, when the visor 6 is to be attached again to the cap body 2, the visor 6 can be disposed at the same mounting position as before removal by fitting the stopper 15 into the cylindrical support 18.

An inner surface of the visor 6 is formed with bosses 19 each surrounding corresponding one of mounting holes 16. Each of the bosses 19 is rotatably fitted in corresponding one of support holes 20 made in left and right opposite ends of the shield plate 5. This ensures that the shield plate 5 can be pivotally moved about pivots provided by the two bosses 19 between a closed position in which the opening 3 in the front face is closed and an opened position in which the opening 3 in the front face is opened. When in the closed position, the shield plate 5 is in close contact with a seal rubber 21 mounted around a peripheral edge of the opening 3 in the front face.

A closure retaining means 22 is mounted in the following manner between the cap body 2 and the shield plate 5 to retain the shield plate 5 pivotally moved to the closed position and is comprised of a first 22, and a second engage element $22_2$.

The first engage element $22_1$ is slidably fitted on the main portion 12 of the adjusting means 9 from its front end side and includes an engage projection 23 at a front end thereof. In the first engage element $22_1$, the machine screw 11 in the adjusting means 9 is inserted as a fixing element into an elongated hole 24 extending in the longitudinal direction of the cap body. This ensures that the first engage element $22_1$ can be moved in the longitudinal direction of the cap body by loosening the machine screw 11. The first engage element $22_1$ is fixed, together with the main portion 12, to the cap body 2 through the machine screw 11 at any position within a region of movement limited by the elongated hole 24 by utilizing the deflection of the main portion 12 in the adjusting means 9.

The body 10 of the adjusting means 9 and the first engage element $22_1$ can easily be fixed in a fitted relation to each other by the single machine screw 11 in this manner, and the relative rotation between the body 10 and the first engage element $22_1$ about the machine screw 11 is reliably prevented by fitting the stopper 15 into the cylindrical support 18.

The second engage element $22_2$ is attached to an upper edge of the shield plate 5 at its laterally central portion and includes a mounting portion 25 extending along the shield plate 5, and a U-shaped engage pawl 26 provided on the mounting portion 25 to project from the upper edge of the shield plate 5. The engage pawl 26 corresponds to the engage projection 23 of the first engage element $22_1$.

In the above construction, the shield plate 5 can be held at the closed position by bringing the engage pawl 26 of the second engage element $22_2$ into engagement with the engage projection 23 of the first engage element $22_1$.

The engagement and disengagement between the engage projection 23 and the engage pawl 26 can smoothly be carried out through the aid of the elasticity of the shield plate 5. In this case, because the second engage element $22_2$ is located at a position remotest from the two mounting positions of the shield plate 5 on the cap body 2, the effective utilization of the elasticity of the shield plate 5 ensures that the second engage element $22_2$ exhibits a larger engaging force, thereby reliably maintaining the closed position of the shield plate 5.

If the closed position of the shield plate 5 is desired to be adjusted, the machine screw 11 may be loosened and with the two engage elements $22_1$ and $22_2$ engaged, the first engage element $22_1$ may be moved and then fixed to the cap body by the machine screw 11.

Figure 5:
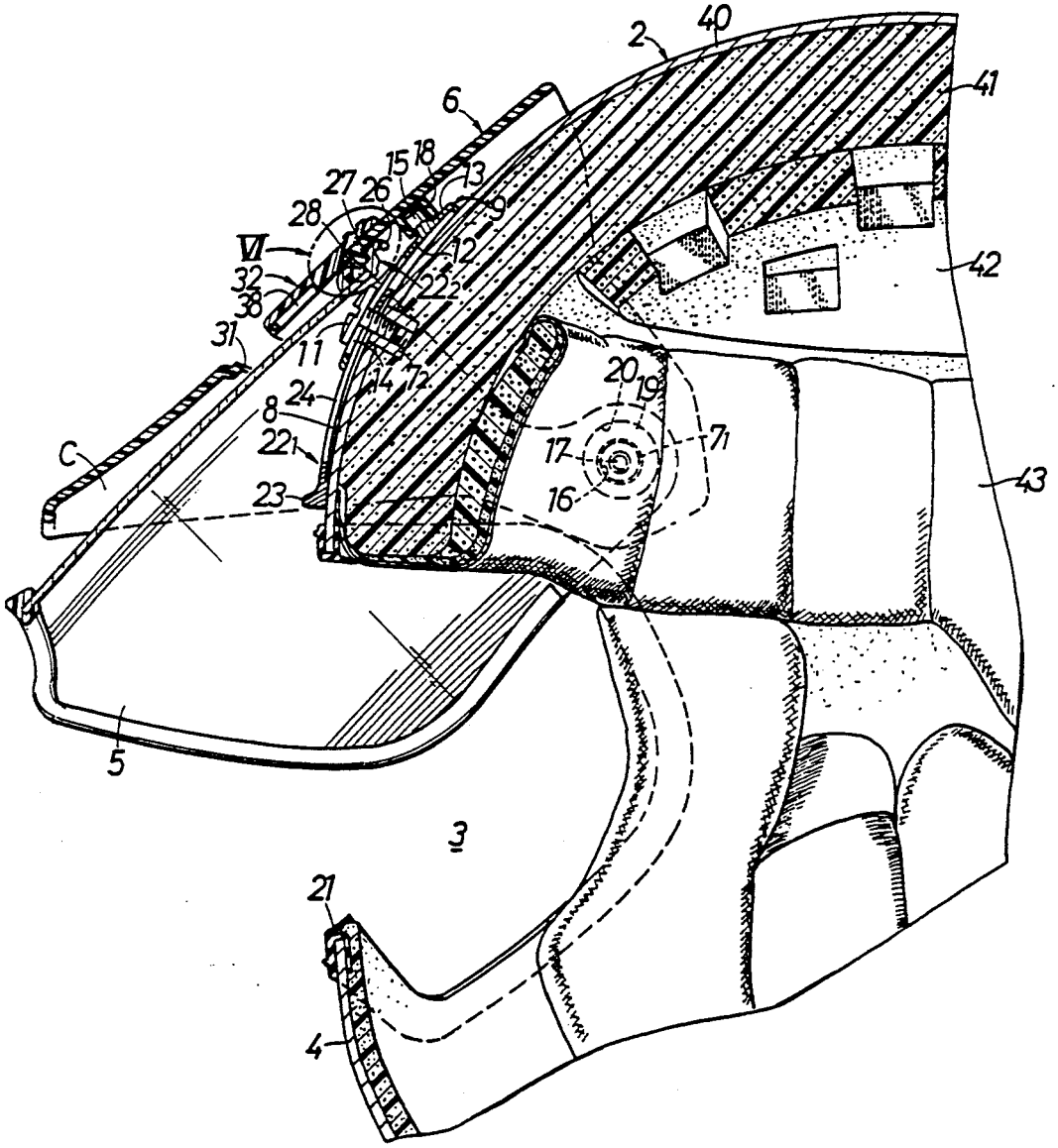
FIG. 5 is a sectional view similar to FIG. 2, but showing the shield plate held at an opened position.

By attaching the visor 6 to the cap body 2 in the above manner, a tip end of the visor 6 projects above the opening 3 in the front face and thus forwardly from the opposed position of the cap body 2 to the front wall 8, thereby defining a housing chamber C between the visor 6 and the front wall 8, as clearly shown in FIG. 5, so that the shield plate 5 pivotally moved to the opened position is received or housed in the housing chamber C.

In this housed state of the shield plate 5, the visor 6 serves as a protecting cover for the shield plate 5, and this makes it possible to avoid the contact of the shield plate 5 with other components.

As clearly shown in FIGS. 2 and 5, a housed-state retaining means 27 is provided between the visor 6 and the laterally central portion of the shield plate 5 for retaining the shield plate 5 housed. The housed-state retaining means 27 is comprised of an engage projection 28 mounted on the inner surface of the visor at the laterally central portion thereof forwardly of the cylindrical support 18, and the engage pawl 26 of the second engage element $22_2$ mounted on the shield plate 5.

Figure 6:
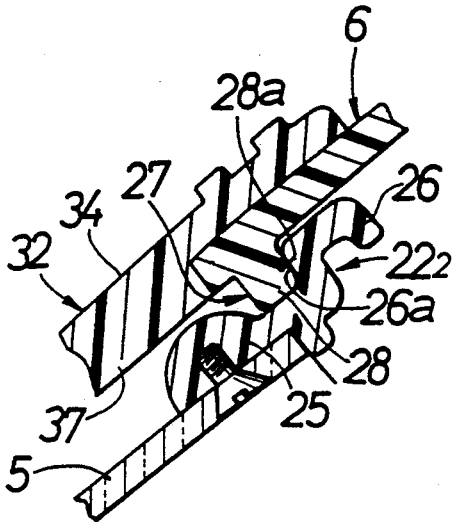
FIG. 6 is an enlarged view of a portion indicated by an arrow VI in FIG. 5.

As clearly shown in FIGS. 5 and 6, in the housed state of the shield plate 5, the engage pawl 26 of the shield plate 5 rides across the engage projection 28 of the visor 6, so that an engage surface **26*a* of the engage pawl 26 which is closer to the mounting portion 25 is engaged with an engage surface 28*a* of the engage projection 28 which is closer to the cylindrical support 18**.

The engagement and disengagement between the engage projection 28 and the engage pawl 26 are achieved by utilizing the elasticity of at least one, e.g., both in the illustrated embodiment, of the shield plate 5 and the visor 6. In this case, the engage projection 28 and the engage pawl 26 are located at positions remotest from the mounting positions of the visor 6 and the shield plate 5 on the cap body 2 and therefore, the effective utilization of the elasticity of the visor 6 and the shield plate 5 ensures that the engage projection 28 and the engage pawl 26 exhibit larger engaging forces, which makes it possible to reliably retain the shield plate 5 housed.

Figure 7:
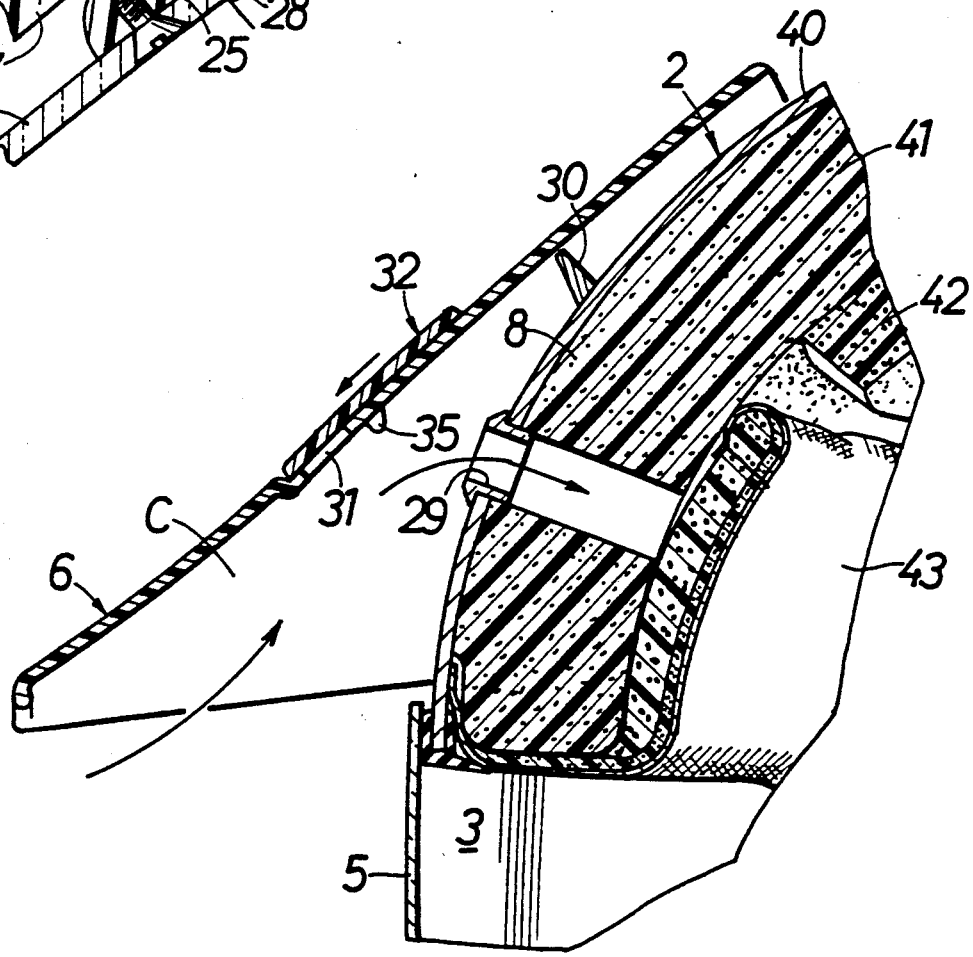
FIG. 7 is a sectional view taken along a line VII—VII in FIG. 1, but showing the shutter as being closed.

As clearly shown in FIGS. 2, 3 and 7, the housing chamber C also serves as travelling-wind flow-in space (which will be identified by the same reference character as the housing chamber C for covenience, hereinafter). In this case, a rear end of the travelling-wind flow-in space C is opened due to fitting of the stopper 15 in the cylindrical support 18 and hence, if a rider wearing the helmet 1 drives a motorcycle, the travelling wind flowing into the space C flows therefrom rearwardly of the visor 6, which makes it possible to prevent the visor 6 from being flapped by the travelling wind even during travelling of the motorcycle at higher speed.

On opposite sides of the main portion 12 of the adjusting means 9, the front wall 8 of the cap body 2 is provided with two air intake holes 29 leading to the travelling-wind flow-in space C. An inlet of each of the air intake holes 29 is opened in an outer surface of the front wall 8, and an outlet of each air intake hole 29 is opened in an inner surface of the front wall 8. The body 10 has a guide wall 30 raised along an upper half peripehral edge in the inlet of each air intake hole 29.

An escape opening 31 is formed into a laterally long rectangular shape in the visor 6 forwardly of the engage projection 28 for permitting the travelling wind to escape therethrough out of the travelling-wind flow-in space C, and a shutter 32 of synthetic resin is mounted on the visor 6 for opening and closing the escape opening 31.

The mounting structure of the shutter 32 on the visor 6 will be described below.

Figure 8:
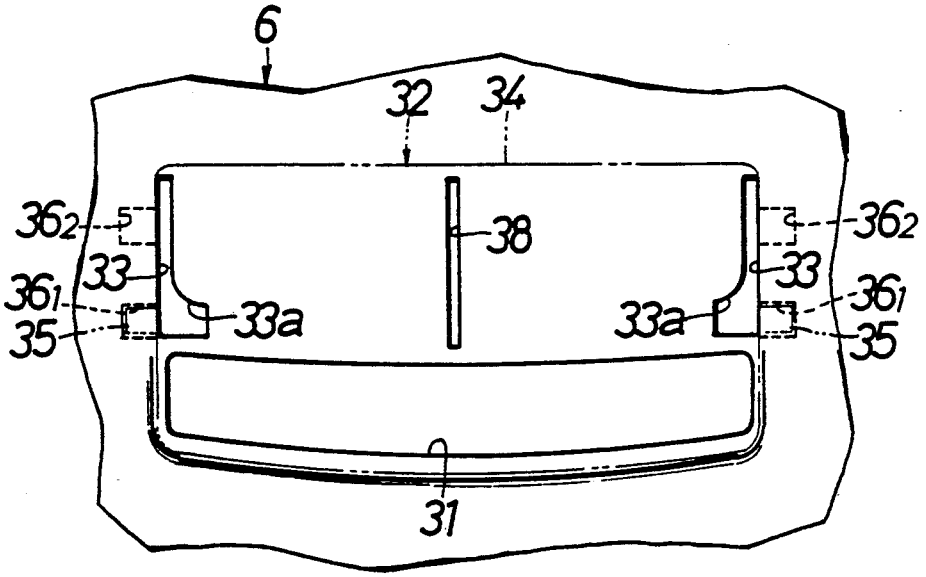
FIG. 8 is a plan view of an essential poriton of a visor.

As clearly shown in FIGS. 3 and 8, a pair of elongated holes 33 are provided in parallel in the visor 6 to extend rearwardly from near the left and right opposite ends of the escape opening 31, and they have front ends which are formed into wider portions 33*a* by notching opposed inner edges of the elongated holes 33. A flat plate portion 34 of the shutter 32 has a size sufficient to completely close the escape opening 31 and is placed on the outer surface of the visor 6. A pair of support legs 35 are provided on a lower surface of the flat plate portion 34 at its left and right opposite side edges and are slidably inserted through the elongated holes 33, respectively. The support legs 35 are hook-shaped with their folded ends 35*a* directed outwardly. Each of the folded ends 35*a* abuts against a lower face of an outer edge of each elongated hole 33. This ensures that each support leg 35 is held in the visor 6 so that it cannot be slipped out.

Figure 9:
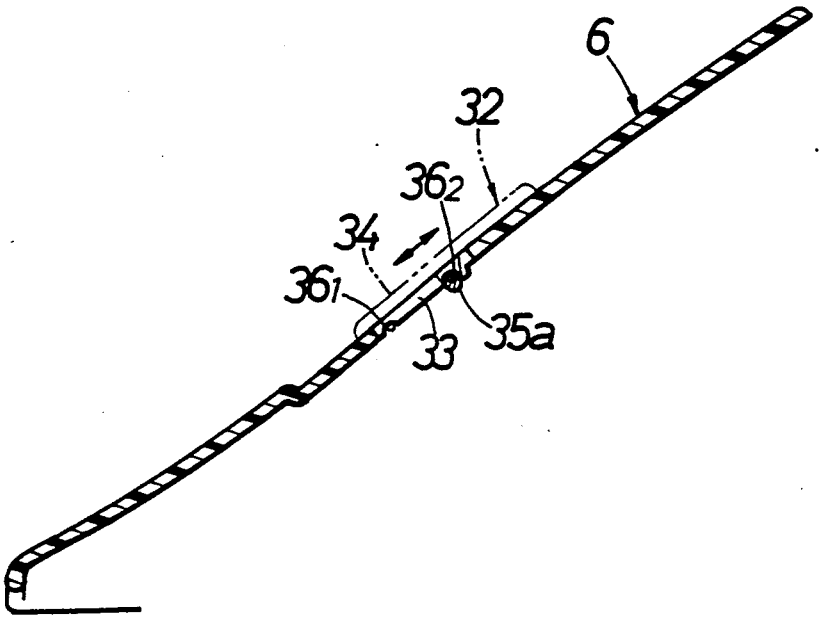
FIG. 9 is a sectional view taken along a line IX—IX in FIG. 1.

As clearly in FIGS. 3, 8 and 9, a first $36_1$ and a second recess $36_2$ are formed at a predetermined distance in the lower face of the outer edge of each elongated hole 33. If the folded end 35*a* of each support leg 35 is engaged into each first recess $36_1$ closer to the escape opening 31, the shutter 32 is located in its closed position in which the escape opening 31 is completely closed by the flat plate portion 34. If the folded end 35*a* is engaged into each second recess $36_2$, the shutter 32 is located in its opened position in which the escape opening 31 is completely opened.

The visor 6 has a guide hole 38 made therein between both the elongated holes 33 in parallel to the elongated holes 33. The shutter 32 has a longitudinally extending guide projection 37 formed thereon at a central portion of the lower surface of the flat plate portion 34 and slidably fitted in the guide hole 38 in the visor 6. The guide projection 37 and the guide hole 38 cooperate to permit a smooth opening and closing movement of the shutter 32.

In attaching the shutter 32 to the visor 6, the wider portion 33*a* of the elongated hole 33 is used to insert each support leg 35 through the corresponding elongated hole 33 by deflecting the flat plate portion 34 so that the two support legs 35 approach to each other.

In the above construction, if the escape opening 31 is closed by the shutter 32, much travelling wind is collected into the travelling-wind flow-in space C by the entire visor 6, so that the pressure in the space C is increased. Hence, the flow rates of travelling wind introduced directly into the air intake hole 29 and travelling wind introduced into the air intake hole 29 through a path bent by the guide wall 30 become maximum. The travelling wind flowing past the air intake hole 29 is guided into the cap body 2 and serves to ventilate the inside of the cap body 2.

On the other hand, if the escape opening 31 is opened by the shutter, the travelling wind in the travelling-wind flow-in space C is escaped through the escape opening 31 by drawing-out effect of the travelling wind flowing along the outer surface of the visor 6, so that the pressure in the space C is reduced. Therefore, the flow rate of wind into the air intake hole 29 if reduced and at the same time, the flapping action of the travelling wind on the visor 6 is reduced.

Such an opening and closing operation of the shutter 32 is conducted in the visor 6 and hence, the operability is good.

Figure 10:
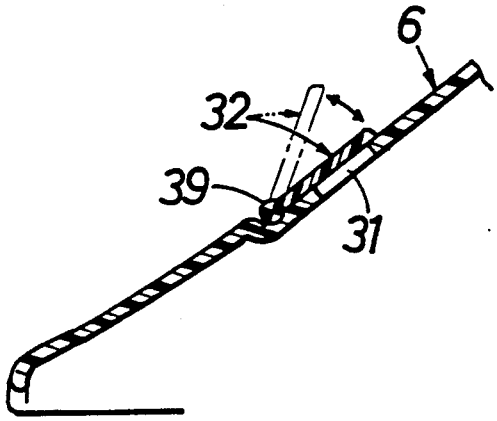
FIG. 10 is a sectional view of a modification of a shutter.

FIG. 10 illustrates a modification of a shutter 32. The shutter 32 is opened and closed through a hinge 39 located at a front efge of the escape opening 31.

As clearly shown in FIG. 2, the cap body 2 is comprised of a shell 40 made of fiber-reinforced synthetic resion, a buffer liner 41 made of foamed polystylene bonded to an inner surface of the shell 40, a top pad 42 covering a ceiling surface of the buffer liner 41, and an air-permeable fit pad 43 covering the inner peripheral surface excluding the ceiling surface of the buffer liner 41 and the chin covering portion 4.

As clearly shown in FIG. 1, at left and right opposite sides thereof, the chin covering portion 4 is provided with a plurality of air intake ports 44 for introducing the travelling wind, and a screen 45 is mounted on an inner surface of the chin covering portion 4 to cover outlets of the air intake ports 44.

It will be understood that the helmet according to the present invention is not limited to the full-face type and includes a jet type.

What is claimed is:

1. A helmet for riding a vehicle, comprising a cap body, a visor mounted on said cap body to define a travelling-wind flow-in space between the visor and a front wall of said cap body, and an air intake hole provided in said front wall to be open to said travelling-wind flow-in space, wherein said visor includes an escape opening for permitting a travelling wind taken into said travelling-wind flow-in space to be escaped therethrough, and a shutter for opening and closing said escape opening.

2. A helmet for riding a vehicle according to claim 1, wherein said visor has a pair of parallel elongated holes extending rearwardly from near and right opposite ends of said escape opening, and a guide hole located between said elongated holes and extending in parallel to the latter, and said shutter includes a pair of support legs each slidably inserted through a corresponding one of said elongated holes and held in said visor against slip-out, and a guide projection slidably fitted in said guide hole.

3. A helmet for riding a vehicle according to claim 1, wherein said shutter is attached to the visor through a hinge located at a front edge of said escape opening.

* * * * *